US005346078A

United States Patent [19]

Ernetoft

[11] Patent Number: 5,346,078

[45] Date of Patent: Sep. 13, 1994

[54] DISPLAY SHELF ASSEMBLY

[76] Inventor: Ulf Ernetoft, 426 Glencairn Ave., Toronto, Ontario, Canada, M5N 1V4

[21] Appl. No.: 105,116

[22] Filed: Aug. 12, 1993

[51] Int. Cl.[5] ..... A47F 5/00

[52] U.S. Cl. ..... 211/90; 211/40

[58] Field of Search ..... 211/90, 94, 187, 153, 211/40, 41, 88

[56] References Cited

U.S. PATENT DOCUMENTS

| | | | |
|---|---|---|---|
| 4,010,697 | 3/1977 | Einhorn | 211/153 X |
| 4,817,900 | 4/1989 | Whittington et al. | 211/94 X |
| 4,844,266 | 7/1989 | Small et al. | 211/94 X |
| 5,031,780 | 7/1991 | Lemmerman et al. | 211/94 X |
| 5,097,969 | 3/1992 | Maxworthy | 211/90 X |

*Primary Examiner*—Alvin C. Chin-Shue
*Assistant Examiner*—Sarah A. Lechok

[57] ABSTRACT

In accordance with the present invention, a shelf assembly is provided, which assembly is comprised by a pair of end brackets, adapted for spaced mounting, in cantilever fashion, on a slotted wall display area, and a shelf element secured to a pair of such brackets, each bracket being provided with a widened, flat horizontal upper surfaced, cantilevered, arm element. A pair of such brackets being comprised by two brackets having opposed, upturned edge flanges on one side only of the flat portion, the upturned flanges being of sufficient height to act as end stops for a shelf supported between the bracket arms and secured to and resting on the flat portions of the arms, the end stops preventing articles, supported on the shelf, from being inadvertently pushed off the ends of the shelf. In the assembly, adapted for display of cassettes, cassette accepting channels are provided in the upper surface of the shelf which support a plurality of cassettes in leaf-through-observation arrangement. Preferably, the channels run lengthwise of the shelf parallel to a shelf supporting display board.

5 Claims, 1 Drawing Sheet

DISPLAY SHELF ASSEMBLY

FIELD OF THE INVENTION

This invention relates to display shelves for the orderly display of a plurality of items such as audio, video and compact disc cassettes and the like. The items to be displayed are arranged in appropriately sized and spaced channels provided in the upper surface of the shelf per se. The shelf assembly, which consists of the shelf element per se and end supports therefor, is adapted to be readily mounted on a vertically oriented, slotted, display board of the type provided with horizontal, on side, L or T shaped slots appropriately vertically spaced. Such slotted display boards are readily obtainable and are widely used in wholesale and retail display areas for small articles. There are various brackets available, which are appropriately shaped for insertion into the slot on a slotted board to provide a shelf support bracket, or hook, arm projecting horizontally from and perpendicular to the board. The known support arms are in the form of a stiff rod or an, on edge, strap provided with a shoulder, on its lower board contacting side, which shoulder rests against the outer surface of the slotted board to hold the arm in a horizontal cantilever position. An upturned outer end is provided on shelf support brackets to prevent a supported shelf inadvertently sliding outwardly off the outer ends of a pair of support brackets.

BRIEF DESCRIPTION OF THE INVENTION

In accordance with the present invention, a shelf assembly is provided, which assembly is comprised by a pair of end brackets, adapted for spaced mounting, in cantilever fashion, on a slotted wall display area, and a shelf element secured to a pair of such brackets, each bracket being provided with a widened, flat horizontal upper surfaced, cantilevered, arm element. A pair of such brackets being comprised by two brackets having opposed, upturned edge flanges on one side only of the flat portion, the upturned flanges being of sufficient height to act as end stops for a shelf supported between the bracket arms and secured to and resting on the flat portions of the arms, the end stops preventing articles, supported on the shelf, from being inadvertently pushed off the ends of the shelf. In the assembly, adapted for display of cassettes, cassette accepting channels are provided in the upper surface of the shelf which support a plurality of cassettes in leaf-through-observation arrangement. Preferably, the channels run lengthwise of the shelf parallel to a shelf supporting display board.

DETAILED DESCRIPTION OF THE INVENTION

Figure 1:
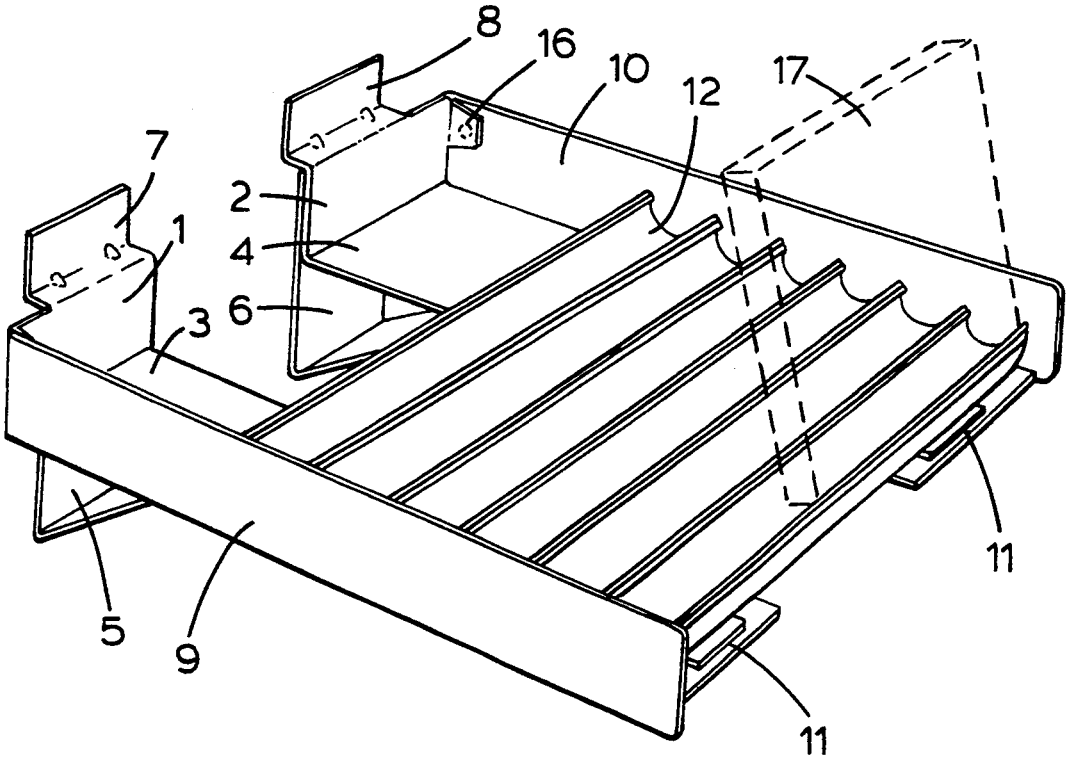
FIG. 1 shows a complete shelf assembly according to the present invention.

Referring now to the complete shelf assembly shown in FIG. 1, the assembly comprises brackets 1, 2 consisting of narrow horizontal strap type arms 3, 4 provided with symmetrically opposed side flanges 9, 10 which are turned up sufficiently to protrude vertically, above the level of a shelf 12, supported on the arms, to act as end stops for the shelf as shown in the drawing. The shelf 12 is secured on and between a pair of such brackets by suitable means such as welding or, as shown in the drawings, by adhesive strips 11. The use of adhesive strips provides the advantage that a shelf can be sized, i.e. cut to a desired length, and assembled to fit a location where the shelf assembly is to be used. For instance, the shelf can be sized to hold two compact disc cassettes, in end to end relationship, in each horizontal slot 13 of the shelf 12.

Figure 2:
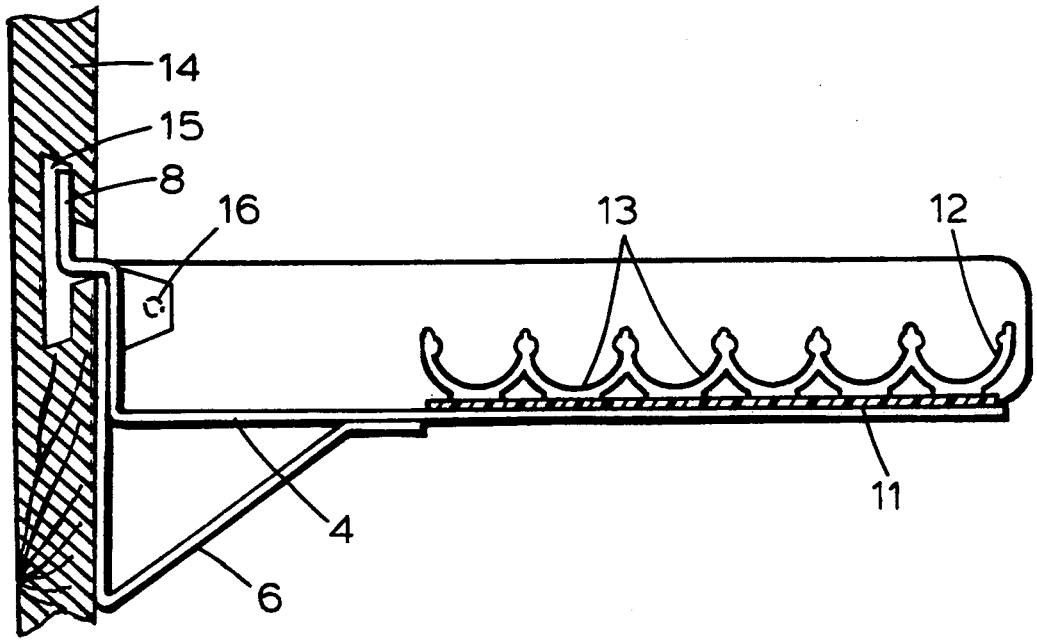
FIG. 2 shows a cutaway side view of a shelf mounted on a slotted display wall.

The brackets, at their inner, or wall, ends have their inner ends of the flat horizontal surface parts bent first upward, then inward and then upwards again as shown clearly in FIG. 2, to provide a vertical, outset tabs 7, 8 which are hooked into the T-slot of the slotted wall 14, FIG. 2. This is a common configuration for the inner ends of known brackets provided for use with slotted walls. In order to provide additional security of the shelf assembly, when mounted on a wall 14, straps 4, bent to form an acute angle, may be fastened to the outer sides of the bent up end portions of the horizontal brackets to provide wide shoulders for wall contact and extended angle braces for supporting the weight of a loaded shelf. The angle parts may be secured to the straps 3, 4 by spot welding, for instance. Furthermore, the bent up parts of the straps 3, 4 may be provided with tabs which are bent over to attach to the upper part of the flanges 9, 10 as shown at 16 in FIG. 2 to provide added rigidity.

Cassette holding shelves, or trays, 12 are available for table or desk setting to hold cassettes in leaf-through arrangement. For further information on the configuration of the slots for the shelf elements, reference can be made to Australian patent 327/26 and U.S. Pat. No. 4,819,813. The manner in which the cassettes are held for leaf-through arrangement is well known and not a feature of the present invention except as described in combination with the supporting brackets forming the assembly according to the present invention.

Although a particular form of the invention has been described herein, it should be understood that modifications may be made in the construction of the assembly which do not depart from the scope and spirit of the present invention as defined by the amended claims. For, instance, the configuration of the brackets may be varied by strengthening ribs or flanges. It is possible to dispense with the underside bracing of the horizontal strap part of the bracket arms by strengthening the bracket arms per se, for instance, by extending the flanges thereof and extending the wall resting shoulder downward so as to provide good wall contact and support for the bracket arm.

I claim:

1. A shelf assembly, for mounting on a vertically oriented display board provided with horizontal slots having at least the upper side undercut so as to accept hook in shelf brackets, comprising a pair of spaced brackets each having an arm adapted to project horizontally from and perpendicular to the display board, each arm having a flat, shelf supporting upper side, the bracket arms being provided with opposed, upstanding, flanges on one side of each arm, each arm having, at its wall end a vertically extending wall contacting surface, the wall contacting surface having, at its upper side, an inturned-to-the-wall part with an upturned hook end part adapted, when the brackets are in position on a display board, to hook into the undercut part of a horizontal slot on a slotted wall display board, a shelf resting on and attached to the flat upper sides of the pair of brackets to form a unitary assembly, and wherein the flanges on the arms of the brackets act as outer shelf end stops to prevent shelf supported items being, inadvertently, pushed sideways off the shelf.

2. A shelf assembly, as claimed in claim 1, wherein the shelf is provided with a group of channels, in parallel arrangement, in the upper side thereof, the channels being adapted to support a plurality of cassettes in leaf-through-observation arrangement.

3. A shelf assembly, as claimed in claim 2, wherein the flanges extend above the bottoms of channels and the channels run parallel to the outer surface of the display board.

4. A shelf assembly, for mounting on a, vertically oriented, wall display board provided with horizontal slots having, at least, the upper side of a slot undercut so as to accept hook-type shelf brackets, comprising a pair of spaced brackets each having an arm adapted to project horizontally from and perpendicular to the surface of the display board, each arm having an extended, flat, upper shelf-supporting surface and an upturned flange on one side thereof symmetrically opposed to the flange on the other bracket arm, each arm having, at the display board end of the arm, a vertically extending board contacting surface the top of which is bent rearward and then upward to provide a vertically extended surface adapted to fit into and hook into the undercut portion of a slot a shelf resting on and secured to the flat upper surfaces of the bracket arms with the flanges of the arms acting as outer end stops for the shelf to prevent shelf supporting items being inadvertently pushed sideways off the shelf and wherein the shelf is provided with a plurality of parallel channels in its upper side, the channels being adapted to hold a plurality of cassettes in spaced leaf-through-observation arrangement.

5. A shelf assembly, as claimed in claim 4, wherein the channels are arranged lengthwise between the bracket flanges, the flanges extending above the bottoms of the channels.

* * * * *